United States Patent [19]

Purdy

[11] 4,235,146

[45] Nov. 25, 1980

[54] BASE DRUM PEDAL ASSEMBLY

[76] Inventor: James R. Purdy, 125 Burgess Ave., Toronto, Canada, M4E 1X3

[21] Appl. No.: 11,988

[22] Filed: Feb. 14, 1979

[51] Int. Cl.[3] ..... G10C 13/14; G10C 13/26; G10D 13/02

[52] U.S. Cl. ..... 84/422 R; 84/72; 84/225; 84/426

[58] Field of Search ..... 84/422 R, 1.27, 72–78, 84/225–232, 353, 357–358, 426, 444

[56] References Cited

U.S. PATENT DOCUMENTS

| | | | |
|---|---|---|---|
| 1,031,598 | 7/1912 | Tobias | 84/422 |
| 1,445,650 | 2/1923 | Strupe | 84/422 |
| 1,604,945 | 10/1926 | Rohr | 84/422 |
| 1,909,761 | 5/1933 | Greenleaf | 84/422 |
| 2,446,508 | 8/1948 | Crowell | 84/422 |
| 2,800,828 | 7/1957 | Moeller | 84/422 |
| 2,893,284 | 7/1959 | Washington, Jr. | 84/422 |
| 3,426,640 | 2/1969 | Slingerland | 84/422 |
| 3,618,441 | 11/1971 | Fearns | 84/422 |
| 3,797,356 | 3/1974 | Duffy et al. | 84/422 |
| 3,930,431 | 1/1976 | Magadini | 84/422 |
| 4,046,049 | 9/1977 | Luce et al. | 84/1.27 X |

FOREIGN PATENT DOCUMENTS

| | | | |
|---|---|---|---|
| 2271626 | 12/1975 | Fed. Rep. of Germany | 84/230 |

*Primary Examiner*—J. V. Truhe
*Assistant Examiner*—Shelley Wade
*Attorney, Agent, or Firm*—Rogers, Bereskin & Parr

[57] ABSTRACT

A base drum pedal assembly is disclosed and includes a foot pedal for operating a beater head, the foot pedal including a foot plate which is slidably mounted on a support coupled to the beater head and which is biased towards a rest position. In use, the player depresses the foot pedal and can, at the same time, slide the foot plate forward against its biasing. At the end of a stroke, the pedal returns upwardly and the foot plate is returned to its rest position by said biasing means.

8 Claims, 4 Drawing Figures

BASE DRUM PEDAL ASSEMBLY

This invention relates to a bass drum pedal assembly.

Conventional bass drum pedal assemblies include a foot pedal pivoted at one end to a base and coupled at the opposite end to a beater head which includes a beater element, usually of generally cylindrical form, carried at an outer end of a beater rod. At its inner end, the beater rod is mounted to pivot about a horizontal axis and the pedal is coupled to the head so that the head pivots forwardly about said axis to bring the beater element into contact with the drum when the foot pedal is depressed. The pedal is returned upwardly by spring action and normally takes the form of a simple flat plate, often shaped to resemble the outline of a human foot. This form of foot pedal assembly is designed to be operated by a rocking action with the player's foot flat on the foot plate, and pivotting on the heel. In practice, this rocking action causes fatigue at the front of the ankle joint of the player. This can be an extreme problem, particularly for a professional musician who might be required to play for as long as twelve hours in a day.

Another problem with conventional bass drum pedal assemblies is that the rocking action discussed above does not allow for a very vigorous beating action, with the result that the musician is not able to achieve the volume which is required in playing, say, as part of a large orchestra or rock group. As a result of this difficulty, some players tend to lift the heel of the foot off the pedal and play using the ball of the foot with a "stamping" action. While this does lead to greater volume, the player effectively loses control of the beater head as it whips back and forth in a beating action. Obviously, this loss of control does not make for precision in playing.

The United States Patent literature contains numerous examples of prior art foot pedal assemblies. For example, U.S. Pat. No. 3,426,640 (Slingerland) contains an excellent illustration of a prior art foot pedal assembly. The patent is concerned with a quick connect arrangement for securing the foot pedal assembly to a drum. U.S. Pat. No. 2,893,284 (Washington Jr.) shows an example of a foot pedal assembly which employs a rocking foot treadle in place of the conventional pivoted foot plate. Another example of a replacement for the conventional foot plate is shown in Moeller's U.S. Pat. No. 2,800,828. In that case, the foot pedal assembly includes a pivoted structure in which the ball of the player's foot rests on a leather roller while his heel is supported on a spool. Magadini's U.S. Pat. No. 3,930,431 discloses a foot pedal assembly which includes a pivoted foot plate, but in this case, the plate is adjustable for both height and proximity to the beater, to suit the personal preferances of the individual player.

While all of these prior art assemblies may be considered to offer some advantages, none of them provide for a natural, comfortable playing action which allows high volumes to be achieved while maintaining precise control over the movement of the beater head.

An object of the present invention is to provide an improved bass drum assembly designed to fullful these requirements.

The assembly provided by the invention has a base, and a beater head including a beater arm and a beater element carried at an outer end of the arm. Means is provided on said base supporting the beater head adjacent an inner end of said arm for pivotal movement about an axis which is disposed generally horizontally when the assembly is in use and is spaced above said base, so that the beater element can move between a forward, beating position for contact with a drum, and a retracted position. Means is provided biasing the beater head towards the retracted position of the beater element. The assembly includes a foot pedal comprising a foot plate and a foot plate support which is pivotally coupled at the heel end thereof to said base and which is inclined upwardly towards a toe end thereof disposed generally below the beater head. The foot plate is mounted on the support for free sliding movement longitudinally thereof towards and away from a rest position adjacent said heel end of the support. The foot pedal also includes means biasing the foot plate towards its said rest position. The foot plate support is coupled to the beater head so that downward movement of the foot pedal causes the head to pivot about said axis to bring the beater element towards its beating position.

In order that the invention may be more clearly understood, reference will now be made to the accompanying drawings which illustrate a preferred embodiment thereof by way of example and in which.

Figure 1:
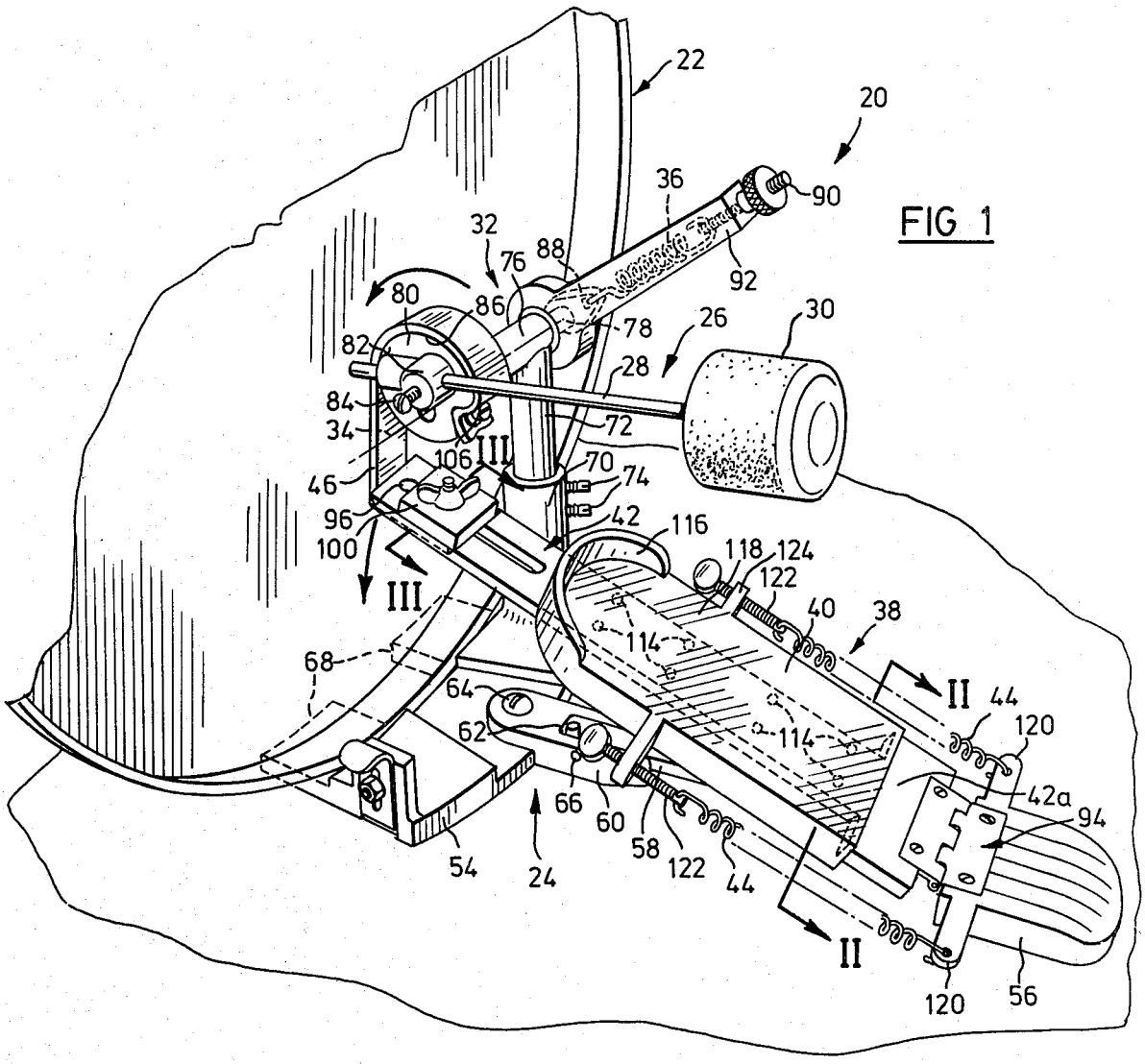
FIG. 1 is a perspective view of a foot pedal assembly according to the invention disposed in a playing position in association with a bass drum.

Referring first to FIG. 1, a bass drum pedal assembly is indicated generally by reference numeral 20 in association with a conventional bass drum 22. Assembly 20 has a base 24 which is of composite construction (see later) and a beater head 26 including a beater arm 28 and a beater element 30 carried at an outer end of arm 28. Disposed on the base is a support structure generally denoted 32 for the beater head 26. The support is designed so that the head can pivot about a generally horizontal axis 34 spaced above the base 24 to bring the beater element 30 from the retracted position in which it is shown in FIG. 1 to a forward beating position for contact with the drum 22. The beater element is shown in this forward position in FIG. 4 but is normally biased towards the retracted position of FIG. 1 by a tension spring 36.

Movement of the beater head is controlled by a foot pedal generally denoted 38. In contrast to the prior art pedal 38 includes a foot plate 40 which can slide back and forth from the rest position in which it is shown in FIG. 1. In playing, plate 40 is mounted for sliding on a support 42 and is biased towards its rest position by two tension springs 44. Support 42 is in the form of a plate which is pivotally coupled at a heel end thereof to a part of the base and which is inclined upwardly towards a toe end disposed generally below the beater head. The toe end of support 42 is coupled to the beater head 26 by a flexible leather strap 46 so that downward movement of the foot pedal 38 causes the beater head to pivot about axis 34 and bring the beater element 30 towards its beating position.

Figure 4:
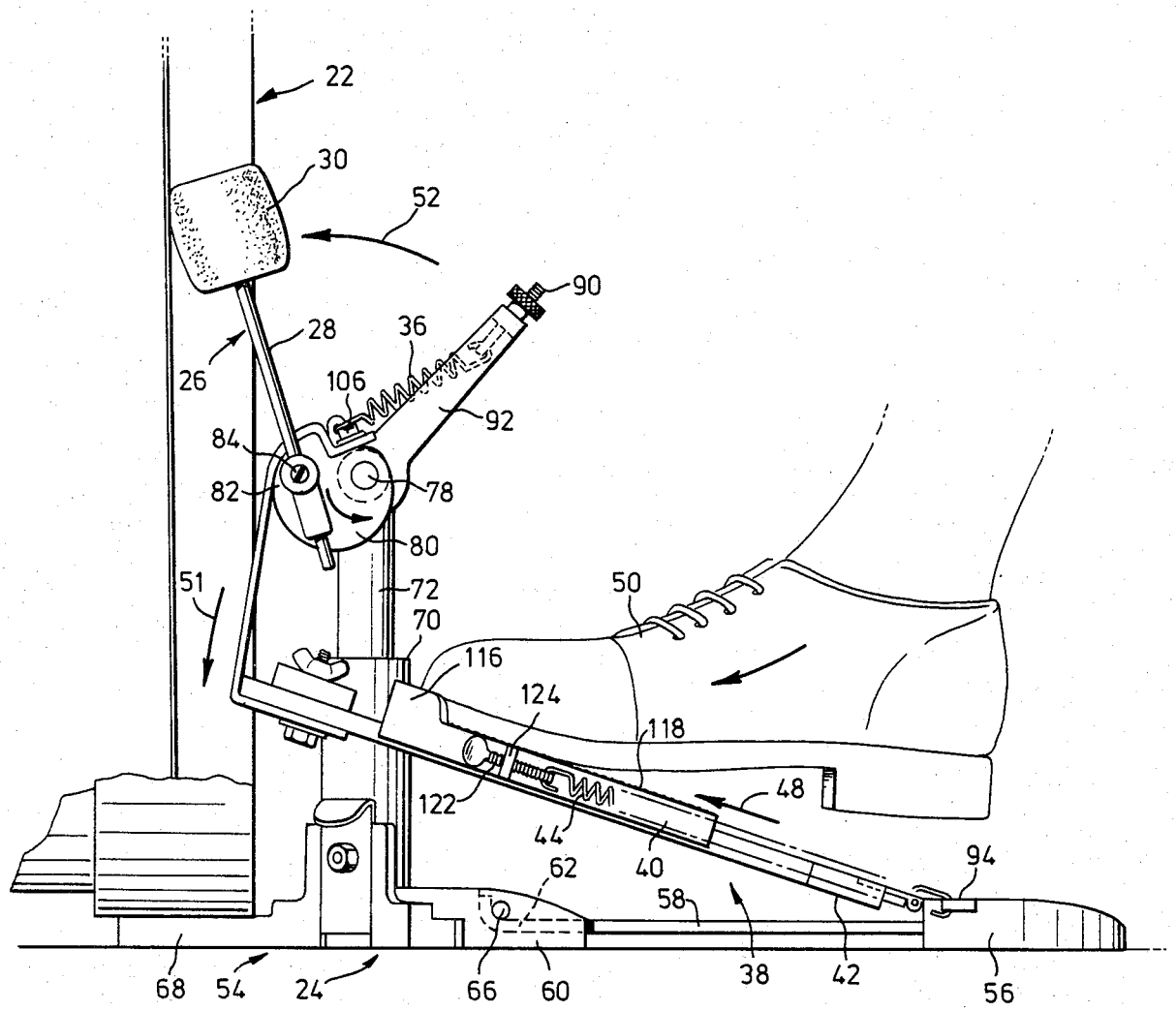
FIG. 4 is a side view showing the foot pedal assembly of FIG. 1 in use.

As indicated previously, the foot plate 40 is freely slidable on support 42. The plate is shown in a rest position in FIG. 1, but can slide longitudinally of support 42 under the action of a player's foot. In FIG. 4, the plate is shown in a position in which it has been moved forwardly in the direction of arrow 48 under the effect of forward motion of a player's foot 50. At the same time, the player has exerted downward pressure on the foot pedal as indicated by arrow 51 to cause the beater head 26 to swing forwardly (arrow 52), bringing the beater element 30 into contact with drum 22. At the end of the stroke, the player relaxes and allows the foot pedal to be returned upwardly by spring 36 and foot plate 40 to be returned to its rest position by springs 44, ready for the next stroke. The player's foot 50 remains in contact with foot plate 40 throughout this movement so that the player retains control over the motion of the beater head. At the same time, the player can lift his heel from the foot pedal and essentially play using the ball of his foot so as to avoid the fatigue problems discussed above in connection with the foot pedal assemblies of the prior art. In practice, it has been found that this foot pedal assembly allows the bass drum to be played with a natural, comfortable action in which the beater heads can be caused to whip vigorously back and forth to provide the loudness required, while allowing the player to maintain control and achieve the rapid response necessary for precision playing.

Having briefly described the principal components of the footpedal assembly, a more detailed description of those components will now be given with reference to the drawings.

As indicated previously, the base 24 of the foot pedal assembly is of composite construction. It comprises front and rear metal castings 54 and 56 respectively joined by a metal rod 58. At its forward end, rod 58 is received in a recess 62 in an element 60 which is secured to casting 54 by a screw 64. The forward end portion of rod 58 is turned upwardly as best seen in FIG. 4, around a horizontal pin 66 which passes through recess 62 for retaining the rod therein. The opposite end of rod 58 is received in a bore in casting 56 and is secured in place by a set screw (not shown). This allows some limited adjustment of the overall length of base 24 to suit the preferences of individual players.

Casting 54 is shaped to define two forwardly protuberant tongues 68 which extend below the rim of the bass drum 22. Although not shown in the drawings, casting 54 will in practice be provided with clamping devices of the type conventionally found in the art for gripping the rim of the bass drum and in effect clamping the pedal assembly to the drum.

At the far side of casting 54 as seen in FIG. 1, an integral, tubular column 70 projects upwardly from the casting and forms part of the support of the beater head 26. A vertical rod 72 is slidably received in column 70 and can be secured in an adjusted vertical position by set screws 74. It will be appreciated by the vertical position of rod 72 determines the vertical position of the beater head 26 and permits the height of the head to be adjusted to suit the preference of a particular player. At its upper end, a sleeve 76 is welded transversely to rod 72 and receives an inner shaft 78 which is freely turnable therein. Shaft 78 and sleeve 76 define the horizontal pivot axis 34 for the beater head 26.

The left hand end of shaft 78 as seen in FIG. 1 is fitted with a boss 80 which is secured to and turns with the shaft. The boss forms a mounting point for the beater head 78 and is formed at its outer side with a cylindrical projection 82 having a transverse bore in which the beater arm 28 is slidably received. A set screw 84 is provided for securing arm 28 in an adjusted position with respect to boss 80. Set screw 84 allows the beater arm 28 to be clamped in boss 80 at an adjusted longitudinal position depending on the required effective length of the beater head 26. Boss 80 has a part cylindrical outer surface 86 around which is wrapped part of the leather strap 46 for connecting the beater head 26 with the foot pedal 38. Thus, it will be appreciated that, if foot pedal 38 is depressed from the position in which it is shown in FIG. 1, the part of strap 46 which is wrapped around boss 80 will partially unwrap and cause the boss to turn in the anticlockwise direction as seen in FIGS. 1 and 4, causing the beater head 26 to swing into contact with the drum 22. FIG. 4 shows strap 46 in this position with beater element 30 in contact with drum 22. It will also be seen from that view that the position of attachment of the beater element 26 to boss 80 is off-set somewhat from axis 34. This is a design feature conventionally found in the art, intended to make for a larger area of contact between the beater element and the drum than would otherwise be achieved.

The right hand end of shaft 78 as viewed in FIG. 1 is fitted with a radially extending arm 88 to which one end of spring 36 is attached. The opposite end of the spring is attached to an adjusting screw 90 carried by a support bracket 92 which projects radially from and is attached to sleeve 76. Thus, as best seen in FIG. 4, when shaft 78 turns, arm 88 is angularly displaced with the shaft, but bracket 92 remains stationary. This causes spring 36 to be tensioned and exert a return biasing force on the shaft and through it, on the beater head 26. The extent of this biasing force can be adjusted by screw 90 according to the preference of individual players. In any event, the effect is to bias beater head 26 to the retracted position in which it is shown in FIG. 1.

The support 42 of foot pedal 38 is, in this embodiment, defined by a metal plate which is generally T-shaped with an elongated stem. The heel end **42*a* of support plate 42 is coupled to the casting 56 of base 24 by a hinge 94 which is recessed into the plate and casting and secured in place by self-taping screws. Adjacent its opposite (toe) end, plate 42 is formed with a longitudinally extending slot 96. The leather strap 46 extends below the slotted portion of plate 42 as can best be seen in FIG. 3 and is formed with an opening receiving the shank of a bolt 98 which extends upwardly through the strap and through the slot 96 in plate 42. The shank of the bolt also passes through a plate 100 disposed on top of plate 42 and is fitted with a wing nut 102. It will be appreciated that, by releasing wing nut 102, the bolt can be moved to an adjusted position along slot 96 and will carry with it the strap 46, thereby permitting adjustment of the effective length of strap 46 and hence the inclination of the foot pedal 38. A washer 104 (FIG. 3) is provided behind the head of bolt 98 for clamping strap 46 in an adjusted position. At its opposite end, the strap is permanently secured in place by a self-taping screw 106 (FIGS. 1 and 4) screwed into boss 80**.

Figure 2:
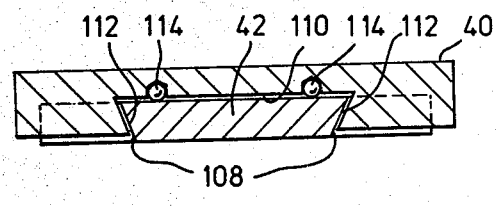
FIGS. 2 and 3 are cross-sectional views on lines II-II and III-III respectively of FIG. 1.
Figure 3:
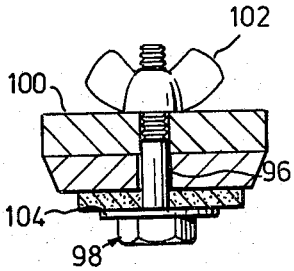

FIGS. 2 and 3 show that the stem portion of plate 42 has undercut side edges 108. The foot plate 40 of the pedal is in the form of a metal plate having in its under surface a longitudinally extending recess 110 of a shape complimentary to the shape of the stem portion of plate 42. Recess 110 has side edges 112 which are shaped to correspond with the undercut side edges 108 of plate 42 so that plate 40 is held on plate 42 but is freely slidable therealong. Four pairs of ball bearings 114 are provided in recesses in the underside of the recess 110 of plate 40 so as to bear on the upper surface of plate 42 as best seen in FIG. 2. This ball bearing arrangement makes for minimum frictional resistance between foot plate 40 and support plate 42 as the foot plate moves back and forth in use. It will, of course, be appreciated that, owing to the shape of recess 110 and plate 42, the foot plate 40 cannot be lifted off the support plate. It must be fitted to and removed from plate 42 from the toe end thereof after removal of bolt 98 and plate 100.

The T-shaped heel end portion 42*a* of plate 42 acts as a stop defining the rest position of the foot plate 40. Thus, in the rest position shown in FIG. 1 the rear edge of foot plate 40 bears against the heel end portion of plate 42. A raised toe piece 116 is provided at the toe end of foot plate 40 and the upper surface of the plate is roughened as indicated at 118 for promoting improved grip of the foot plate.

The two tension springs 44 which biased the foot plate 40 to its rest position extend between integrally cast lugs 120 on base casting 156 and two screw threaded adjusting bolts 122 which are threaded into complementary holes in lugs 124 welded to plate 40 so as to project laterally therefrom but generally parallel to the lugs 120. Thus, by turning the bolts 122, the tension in the springs 44 can be adjusted to vary the return biasing force which is applied to the foot plate by the springs in use.

It will, of course, be appreciated that the preceding description relates to a preferred embodiment of the invention only, and that many modifications are possible within the broad scope of the claims. For example, the foot plate 40 of the pedal may be shaped to resemble the shape of a human foot generally in the manner of conventional foot pedals. Also, the plate and its support may be of different designs. In another embodiment, for example, the support could be in the form of a rod-like structure on which the foot plate would be slidably supported. Guide wheels, low friction surface coatings or other expedients may be employed to provide for free sliding movement of the foot plate with respect to its support.

Different biasing arrangements may also be employed for the foot plate. In another embodiment it would, for example, be possible to use a single biasing spring connected between the base and the rear edge of the foot plate, or positioned below the foot plate support and coupled to the plate through a slot in the support. In another case, the biasing means for the foot plate may be omitted entirely.

Other variations well-known in the art may be employed in the design of the base and supports of the beater head. For example, in another embodiment, the beater head could be coupled to a shaft extending between two support columns, (or the like) generally disclosed in the Slingerland patent discussed previously.

Other forms of coupling means (e.g. a rigid link) may be provided between the foot plate support and the beater head. Also, the base need not project beyond the foot plate support or include a heel plate (as casting 56); the base may terminate below the support and be pivotally coupled thereto by a pivot also below the support.

I claim:

1. A bass drum pedal assembly comprising:

a base;

a beater head including a beater arm and a beater element carried at an outer end of said arm;

means on said base supporting said beater head adjacent an inner end of said arm for pivotal movement about an axis which is disposed generally horizontally when the assembly is in use and is spaced above said base, whereby said beater element can move between a forward, beating position for contact with a drum, and a retracted position;

means biasing said beater head towards said retracted position of the beater element;

a foot pedal comprising: a foot plate; a foot plate support pivotally coupled at a heel end thereof to said base and inclined upwardly towards a toe end thereof disposed generally below said beater head, said foot plate being mounted on said support for free sliding movement longitudinally thereof towards and away from a rest position adjacent said heel end of the support; and means biasing said foot plate towards said rest position; and, means coupling said foot plate support to said beater head so that downward movement of the foot pedal causes said head to pivot about said axis to bring said beater element towards its beating position.

2. An assembly as claimed in claim 1, wherein said foot plate support comprises a generally T-shaped plate having an elongated stem portion, said plate being disposed with the head of said T defining said heel end of the support, and wherein said foot plate is slidably mounted on said stem portion of the plate so as to abut against the head portion thereof in said rest position, whereby said rest position is defined by said head portion.

3. An assembly as claimed in claim 2, wherein said stem portion of the support plate has undercut longitudinally extending side edges, and wherein the foot plate has in its underside, a longitudinally extending recess of a cross-sectional shape generally complimentary to the cross-sectional shape of said stem portion, said foot plate being fitted to the support so that its said recess receives the stem portion of the support plate, whereby the foot plate is retained on said support but is freely slidable longitudinally thereof.

4. An assembly as claimed in claim 3, further comprising low-friction bearing means disposed between an upper surface of said stem portion of a support plate and an opposing face of said recess of the foot plate, whereby said bearing means support said foot plate for free sliding movement longitudinally of said support plate.

5. An assembly as claimed in claim 1, wherein said means biasing the foot plate towards its rest position comprise two tension springs positioned one on each side of said foot plate and extending between said plate and said base, and means for adjusting the biasing effect of each of said springs.

6. An assembly as claimed in claim 2, wherein said beater head support means includes a freely turnable shaft extending about said axis, a coupling element mounted on said shaft for turning movement therewith, and including means retaining said beater arm adjacent its inner end, said coupling element including a part cylindrical outer surface extending around said axis, and wherein said means coupling the foot plate support of the beater head comprise a strap attached at a first end thereof to said support plate and extending upwardly therefrom and around said part cylindrical surface of the coupling element, said strap being attached at the second end thereof to said coupling element, whereby downward movement of the pedal in use causes such strap to partly unwrap from said part cylindrical surface of the coupling element, turning said element to bring the beater head towards its beating position.

7. An assembly as claimed in claim 6, further comprising means adjustably clamping the first end of said strap to said support plate, said clamping means comprising a clamping bolt assembly including a bolt extending through said strap and through a longitudinal opening in said stem portion of the support plate, and a releasable clamping nut for clamping the strap against said plate.

8. In a base drum pedal assembly comprising a base, a beater head including a beater arm and a beater element carried at an outer end of said arm, means on said base supporting said beater head adjacent an inner end of said arm for pivotal movement about an axis which is disposed generally horizontally when the assembly is in use and is spaced above said base, whereby the beater element can move between a forward, beating position for contact with a drum, and a retracted position, means biasing the beater head towards said retracted position of the beater element, a foot pedal pivotally coupled outer heel end thereof to said base, and means coupling the foot pedal to said beater head so that downward movement of the foot pedal causes the head to pivot about said axis to bring the beater element towards its beating position;

the improvement wherein said foot pedal comprises a foot plate, a foot plate support pivotally coupled at a heel end thereof to said base and inclined upwardly towards a toe end thereof disposed generally below said beater head, said foot plate being mounted on said support for free sliding movement longitudinally thereof between a rest position adjacent said heel end of the support and an advanced position adjacent said beater head, and wherein the pedal assembly further comprises first and second abutment means carried by said support and adapted to co-operate with said foot plate to respectively define said rest position and said advanced position of the foot plate.

* * * * *